US005095641A

United States Patent [19]

Dahl

[11] Patent Number: 5,095,641

[45] Date of Patent: Mar. 17, 1992

[54] EXPANDABLE PICTURE FRAME ASSEMBLY WITH ENCLOSED VARIABLE-SIZE MULTIPLE PICTURE-STORING CAVITY

[76] Inventor: Gary A. Dahl, 4410 Durham Ct., Denver, Colo. 80239

[21] Appl. No.: 745,011

[22] Filed: Aug. 14, 1991

Related U.S. Application Data

[63] Continuation-in-part of Ser. No. 578,634, Sep. 6, 1990.

[51] Int. Cl.[5] ..... A47G 1/08

[52] U.S. Cl. ..... 40/156; 40/152

[58] Field of Search ..... 40/152, 156, 155

[56] References Cited

U.S. PATENT DOCUMENTS

| | | | |
|---|---|---|---|
| 387,779 | 8/1888 | Erschell | 40/156 |
| 957,539 | 5/1910 | Berkebile | 221/26 |
| 3,769,730 | 11/1973 | Dole | 40/156 |

FOREIGN PATENT DOCUMENTS

| | | | |
|---|---|---|---|
| 1380155 | 1/1975 | United Kingdom | 221/58 |

*Primary Examiner*—Kenneth J. Dorner
*Assistant Examiner*—Milton Nelson, Jr.
*Attorney, Agent, or Firm*—John R. Flanagen

[57] ABSTRACT

An expandable picture frame assembly includes an annular enclosure and a resiliently flexible spring. The enclosure has a front, a rear, and an interior surface bounding a picture-storing cavity defined between the front and rear of the enclosure. In one embodiment, the spring member is attached to the interior surface of the enclosure and projects partially across the cavity. The spring member is capable of being flexed toward and away from the front and rear of the enclosure for holding multiple pictures in a compact stacked arrangement behind one another with only a front one being displayed through a front opening of the enclosure. In another embodiment, the flexible spring member extends across the cavity between, and is releasably engaged at its opposite ends with, oppositely facing portions of the interior annular surface of the enclosure. The spring member is capable of being flexed between opposite overcentered positions for respectively holding the pictures in the stacked arrangement within the cavity or for releasing the spring member to permit insertion or removal of the pictures to or from the cavity. The picture frame assembly also includes a transparent pane disposed in the enclosure forwardly of the spring member and across the front opening of the enclosure, and a stiff backing plate disposed in the enclosure rearwardly of the transparent pane and engaged by the spring member.

9 Claims, 4 Drawing Sheets

EXPANDABLE PICTURE FRAME ASSEMBLY WITH ENCLOSED VARIABLE-SIZE MULTIPLE PICTURE-STORING CAVITY

CROSS-REFERENCE TO RELATED APPLICATION

This application is a continuation-in-part of copending U.S. patent application Ser. No. 578,634, filed Sept. 6, 1990.

BACKGROUND OF THE INVENTION

1. Field of the Invention

The present invention generally relates to a picture frame for holding and displaying a picture and, more particularly, is concerned with an expandable picture frame assembly with an enclosed variable-size multiple picture-storing cavity.

2. Description of the Prior Art

Typically, every year many families employ the services of a professional photographer to take a family picture. Also, it is common practice each year for elementary and secondary schools to permit a photographer to solicit the taking of pictures of students attending the schools for selling to parents of the students.

These annual family and student pictures are commonly placed in picture frames and hung on walls or displayed on desktops. Frequently, these new annual pictures are substituted for last year's pictures which had been displayed in the same picture frames.

Ordinarily, the replaced pictures are stored away in a drawer or an empty shoe box. The pictures from past years, though treasured items, tend to accumulate and oftentimes become lost or damaged due to lack of care in their handling and storage.

Consequently, a need exists for a convenient and safe way in which past years' pictures can be replaced by new current pictures but still easily protected from potential damage or loss during storage.

SUMMARY OF THE INVENTION

The present invention provides an expandable picture frame assembly designed to satisfy the aforementioned needs. Unlike a prior art picture frame which typically contains only a single picture, the expandable picture frame assembly of the present invention employs an enclosed variable-size picture-storing cavity for confining and holding multiple photographs in a compact stacked arrangement behind one another with only the lead one being displayed through a front transparent pane of the frame.

Thus, the expandable picture frame assembly permits convenient storage of past years' pictures behind the current year's picture which is displayed by the picture frame. Storage of the pictures of earlier years in the expandable picture frame assembly of the present invention also permits almost instantaneous retrieval of these pictures when one desires to show them as well as the current year's picture.

Accordingly, the present invention is directed to an expandable picture frame assembly which includes an annular enclosure and a resiliently flexible spring member. The annular enclosure has a front and a rear and an interior annular surface bounding a cavity defined by the enclosure between the front and rear thereof for storing multiple pictures in a stacked arrangement behind one another. The front of the enclosure has an opening to the cavity for displaying only a front one of the pictures in the stacked arrangement through the front opening. The rear of the enclosure has an opening for inserting and removing the pictures. The flexible spring member is mounted to the interior surface of the annular frame within the cavity and projects across the cavity. The spring member is capable of being manually flexed toward and away from the front and rear of the enclosure for permitting insertion and removal of the pictures and for holding the pictures in the stacked arrangement within the cavity.

The expandable picture frame assembly also includes a transparent view pane disposed in the frame forwardly of the spring member and across the front opening of the frame, and a relatively stiff backing plate disposed in the frame rearwardly of the transparent view pane and engaged on a rear side by the spring member. Also, the frame assembly includes a rear planar cover slidably mountable in a track defined by a pair of longitudinal aligned slots defined along oppositely-facing portions of the interior surface of the frame. The rear cover is provided to open and close the rear opening of the frame.

The spring member normally engages the rear side of the backing plate for holding the plurality of pictures in the compact stacked relation against the transparent view pane. Two embodiments of the spring member are discloses. In one embodiment, the spring member is attached to the interior surface of the enclosure and projects partially across the cavity. The spring member is capable of being flexed toward and away from the front and rear of the enclosure for holding multiple pictures in the compact stacked arrangement behind one another with only a front one being displayed through a front opening of the enclosure. In another embodiment, the flexible spring member extends across the cavity between, and is releasably engaged at its opposite ends with, oppositely facing portions of the interior annular surface of the enclosure. The spring member is capable of being flexed between opposite overcentered positions for respectively holding the pictures in the stacked arrangement within the cavity or for releasing the spring member to permit insertion or removal of the pictures to or from the cavity.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
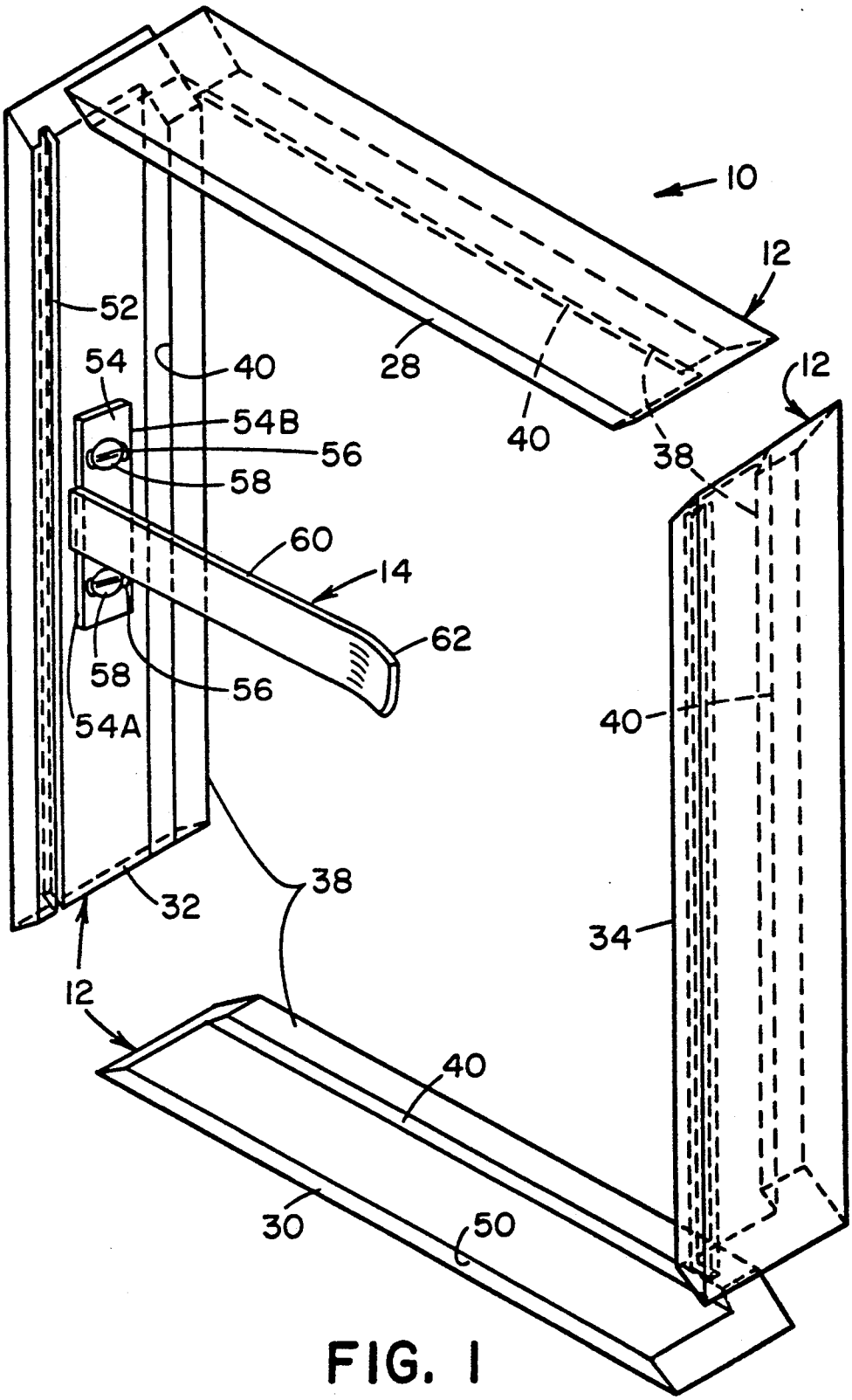
FIG. 1 is a rear perspective exploded view of an annular enclosure and one embodiment of a flexible spring member of an expandable picture frame assembly of the present invention.
Figure 2:
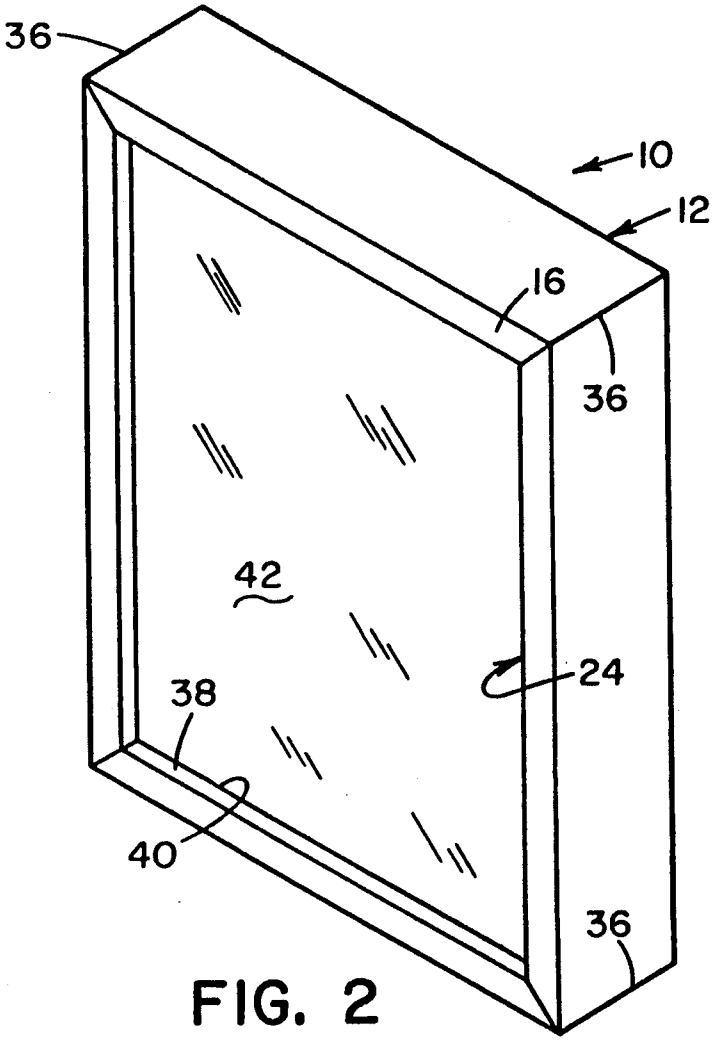
FIG. 2 is a front perspective assembled view of the expandable picture frame assembly.
Figure 3:
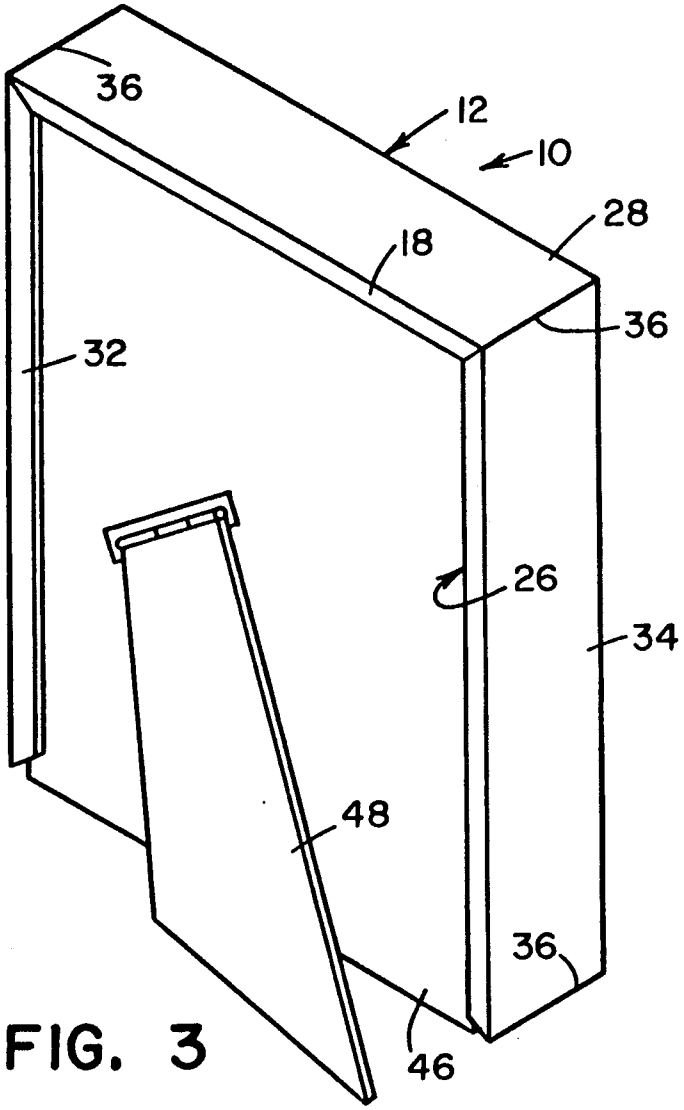
FIG. 3 is a rear perspective assembled view of the expandable picture frame assembly.
Figure 4:
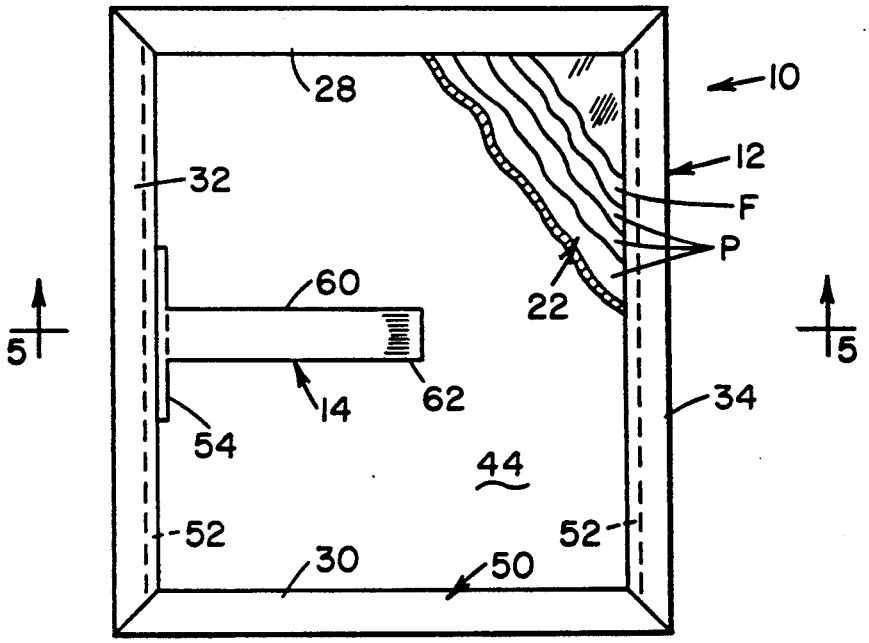
FIG. 4 is a rear elevational view of the expandable picture frame assembly without the rear cover.
Figure 5:
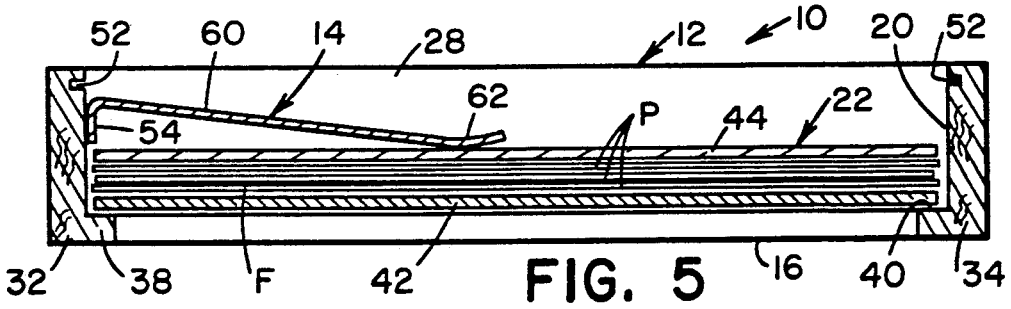
FIG. 5 is an enlarged cross sectional view of the expandable picture frame assembly taken along line 5—5 of FIG. 4.
Figure 6:
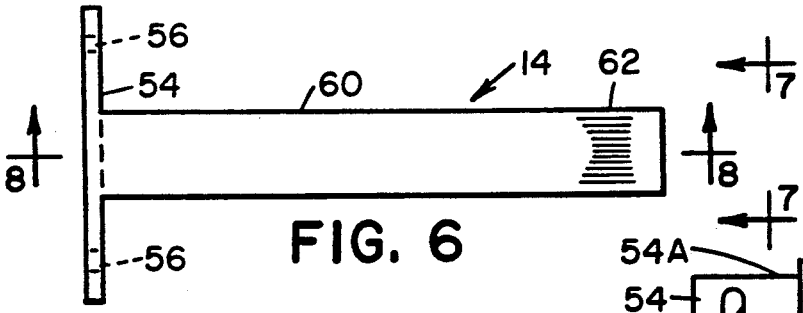
FIG. 6 is an enlarged plan view of the flexible spring member of FIG. 1 by itself.
Figure 7:
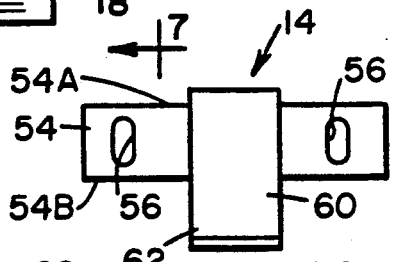
FIG. 7 is a longitudinal sectional view of the flexible spring member taken along line 7—7 of FIG. 6.
Figure 8:
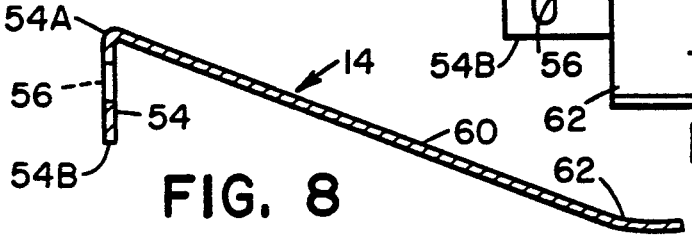
FIG. 8 is an end elevational view of the flexible spring member as seen along line 8—8 of FIG. 6.

In the following description, like reference characters designate like or corresponding parts throughout the several views of the drawings. Also in the following description, it is to be understood that such terms as "top", "bottom", "front", "rear" and the like, are words of convenience and are not to be construed as limiting terms.

Referring to the drawings, and particularly to FIGS. 1-5, there is shown an expandable picture frame assembly of the present invention, generally designated 10. In its basic components, the expandable picture frame assembly 10 includes an annular enclosure 12 and a resiliently flexible spring member 14. The annular enclosure 12 has a front 16 and a rear 18 and an interior annular surface 20 disposed between the front and rear 16, 18 of the enclosure 12. The interior annular surface 20 bounds a cavity 22 in the enclosure 12 between the front 16 and rear 18 thereof for storing multiple pictures P in a stacked arrangement behind one another. The front 16 of the enclosure 12 has an opening 24 to the cavity 22 for displaying only a front one F of the pictures P in the stacked arrangement through the front opening 24. The rear 18 of the enclosure 12 also has an opening 26 for inserting and removing the pictures P.

More particularly, the annular enclosure 12 is a box-like annular frame 12 composed by generally straight top and bottom members 28 and 30, and a pair of opposite side members 32 and 34 spaced apart and extending between the top and bottom members 28, 30. The top, bottom and side members 28, 30, 32, 34 are beveled or mitered at their respective opposite ends and rigidly connected together to form generally square corners 36 on the box-like frame 12. Also, the top and bottom members 28 and 30 and opposite side members 32 and 34 together define the interior surface 20 of the frame 12. The frame 12 can be composed of any suitable material, such as wood.

Further, the frame 12 has an interior annular rim 38 formed about the interconnected top and bottom members 28, 30 and opposite side members 32, 34 at the front 16 of the frame 12. The interior rim 38 defines the display opening 24 at the front 16 of the frame 12 and an annular shoulder 40 extending about the rear side of the interior rim 38 and facing toward the rear opening 26 of the frame 12.

FIGS. 1 and 4-8 illustrate one embodiment of the flexible spring member 14 employed by the expandable picture frame assembly 10. The resiliently flexible spring member 14 is mounted to the interior surface 20 of the annular frame 12 within the cavity 22 and projects partially across the cavity 22. As illustrated, the spring member 14 is mounted to one side member 32. The flexible spring member 14, composed of any suitable material, for example spring steel, is capable of being manually flexed toward and away from the front 16 and rear 18 of the frame 12 for holding multiple pictures P in a compact stacked arrangement behind one another with only the front picture F being displayed through the front display opening 24 of the frame 12.

Also, the expandable picture frame assembly 10 includes a transparent view pane 42 and a relatively stiff backing board or plate 44. The transparent view pane 42, composed of glass or plastic, is disposed in the frame 12 forwardly of the flexible spring member 14, against the shoulder 40 on the rear side of the annular rim 38 and across the front display opening 24 defined by the interior rim 34. The backing plate 44 is disposed in the box-like frame 12 rearwardly of the transparent pane 42 and is engaged on its rear side by the flexible spring member 14.

The top member 28, bottom member 30, and opposite side members 32, 34 of the frame 12, and the transparent pane 42 and backing plate 44 enclose the picture-storing cavity 22. The yieldable pressing of the flexible spring member 14 against the rear side of the backing plate 44 permits the picture-storing cavity 20 to vary in size between the transparent pane 42 and backing plate 44 for confining and holding different numbers of pictures P in a compact stacked arrangement behind one another. Again, only the front picture F is displayed through the transparent pane 42 at the front display opening 24 of the frame 12.

Also, the expandable picture frame assembly 10 includes a rear or back cover 46 to close the rear opening 26 of the frame 12. In the illustrated embodiment, the back cover 46 has a hinged flap or leg 48 operable in a conventional manner for standing the expandable picture frame assembly 10 on a support surface, such as a desk. Alternatively, a hanger could be provided on the back cover 46 for use in hanging the expandable picture frame assembly 10 from a wall. More particularly, the bottom member 30 of the frame 12 has a recessed region 50 at the rear 18 of the frame 12 relative to the remaining frame members. Also, the opposite side members 32, 34 have longitudinal slots 52 defined therein along the interior surface 20 of the frame. The slots 52 are aligned with one another and with recessed region 50 of the bottom member 30 to define a linear track for receiving and supporting the rear cover 46 in closing rear opening 26 of the frame 12.

Referring to FIGS. 1 and 5-8, the flexible spring member 14 has a base portion 54 with at least one and preferably a pair of holes 56 for receiving screws 58 to mount the spring member 14 to the interior surface 20 of the frame 12. While the spring member 22 is shown mounted to one side member 32, it could equally be mounted to either the other side member 34 or to the top member 28 or bottom member 30. The spring member 14 also has an arm portion 60 connected to and projecting in cantilevered fashion from the base portion 54 into the picture-storing cavity 22, approximately half the distance between the side members 32, 34. The holes 56 are elongated or oblong in configuration in a direction generally perpendicular to plane of the backing plate 44 and thus are oriented to permit movable adjustment of the spring member 14 toward and away from the backing plate 44 to corresponding increase and decrease the force applied by the arm portion 60 of the spring member 14 against the rear side of the backing plate 44.

Preferably, the spring member 14 is composed of a suitable metal material and has a one-piece structure, with the base and arm portions 54, 60 of the spring member 14 being integrally connected to one another. The arm portion 60 of the spring member 14 throughout most of its length, except for a free end 62 of the arm portion 60, extends in an inclined planar configuration and a generally transverse relation to the plane of the base portion 54 thereof. The base portion 54 is longer than the arm portion 60 is wide but is shorter than the longitudinal length of the arm portion 60. The base portion 54 thus protrudes in opposite directions beyond opposite longitudinal edges of the arm portion 60. The holes 56 are located in the respective regions of the base portion 54 protruding beyond the arm portion 60.

Further, the arm portion 60 extends from above the upper edge 54A of the base portion 54 along the inclined plane to below the lower edge 54B thereof to the free end 62 of the arm portion 60. The free end 62 of the arm portion 60 is slightly arcuate in shape and engages the rear side of the backing plate 44 for holding the plurality of pictures P in the compact stacked relation against the transparent view pane 42. The free end 62 of the arm portion 60 may have a piece of felt material (not shown) adhered thereon for engaging the backing plate 44.

To insert or remove the transparent pane 42, the backing plate 44 and the stack of pictures P to and from the cavity 22, first, the spring member 14 is manually flexed and held away from the backing plate 44. Then, by pushing against the front side of the transparent pane 42, the pane 42, backing plate 44 and pictures P can be lifted to partially extend from the cavity 22 and through the rear opening 26. Once the insertion or removal of the items is completed, the spring member 14 is gently released.

Figure 9:
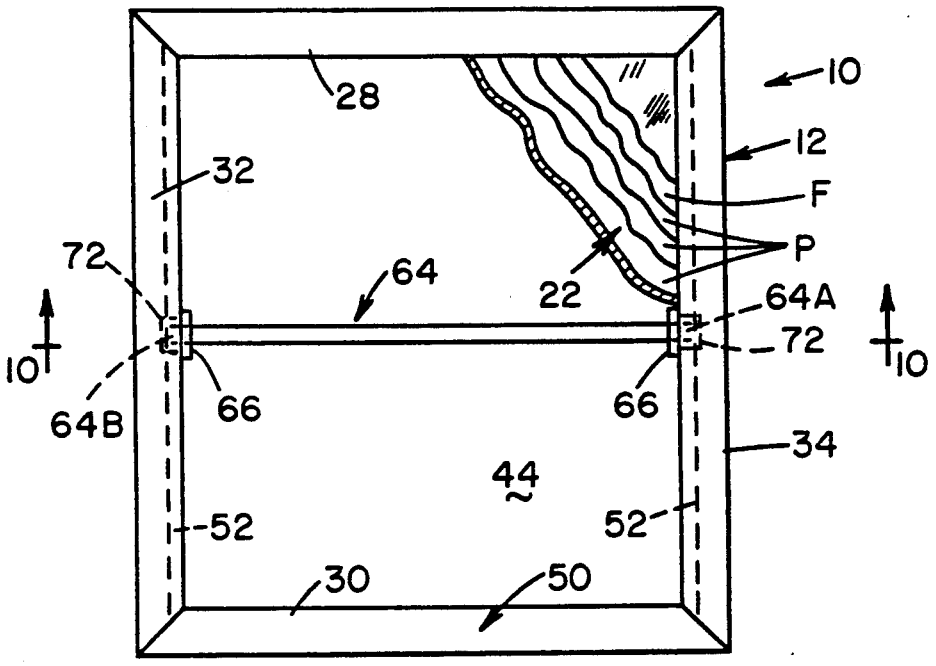
FIG. 9 is a rear elevational view of the expandable picture frame assembly without the rear cover and showing another embodiment of a flexible spring member and a pair of locating members employed in the expandable picture frame assembly.
Figure 10:
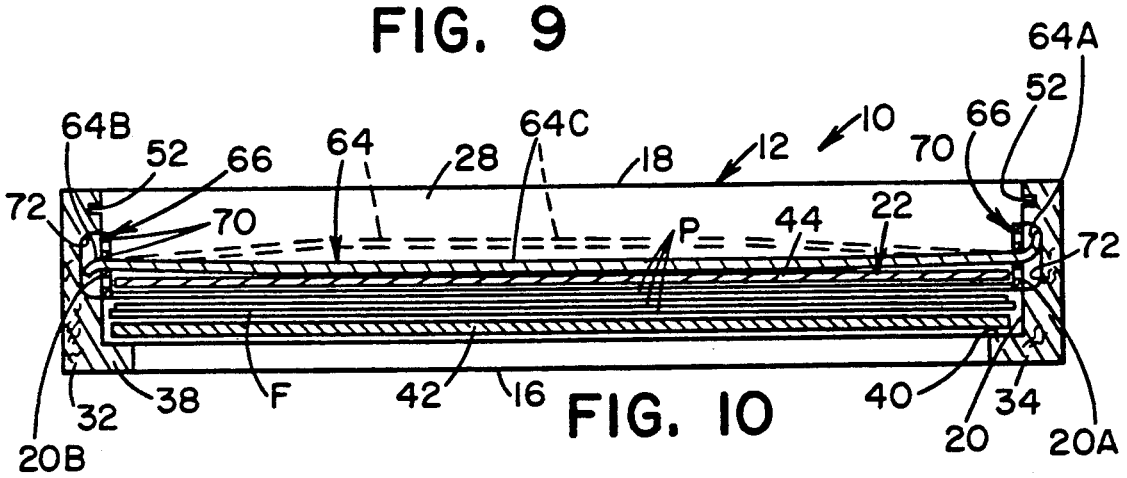
FIG. 10 is an enlarged cross sectional view of the expandable picture frame assembly taken along line 10—10 of FIG. 9.
Figure 11:
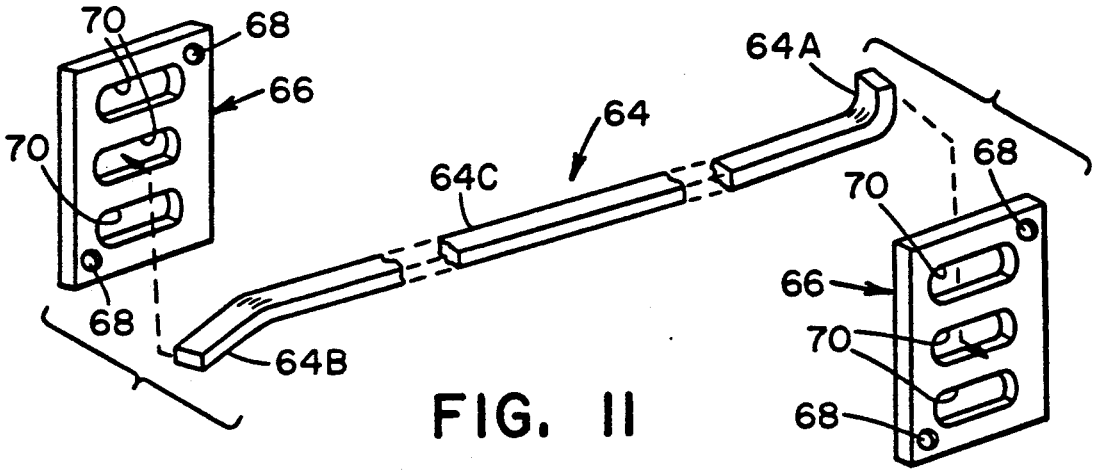
FIG. 11 is an enlarged perspective exploded view of the flexible spring member and locating members of FIG. 9 being removed from the expandable picture frame assembly.

Referring to FIGS. 9-11, there is illustrated another embodiment of the resilient flexible spring member 64 employed by the expandable picture frame assembly 10. The spring member 64 is an elongated one-piece structure, with one opposite end 64A having a hooked configuration and the other opposite end 64B having a slightly bent or downturned configuration. The spring member 64 is disposed between the front 16 and rear 18 of the annular enclosure 12 and extends across the cavity 22 between oppositely facing portions 20A, 20B of the interior annular surface 20 of the enclosure 12. The spring member 64 is releasably engaged at its opposite ends 64A, 64B with the oppositely facing interior surface portions 20A, 20B.

The flexible spring member 64 is composed of any suitable material, for example spring steel, and has a length slightly greater than the distance between the oppositely-facing interior surface portions 20A, 20B. Its greater length and flexibility provides the spring member 64 with the capability of being manually flexed between first and second overcentered positions, as shown in solid line and dashed line forms in FIG. 10. When the spring member 64 is flexed in one direction toward the front 16 of the enclosure 12 to the first, solid-line, overcentered position of FIG. 10, the middle portion 64C of the spring member 64 bears against the backing plate 44 and holds the pictures in the stacked arrangement within the cavity 22. On the other hand, when the spring member 64 is flexed in the opposite direction away from the front 16 of the enclosure 12 to the second, dashed-line, overcentered position of FIG. 10, the middle portion 64C of the spring member 64 flexes away from the backing plate 44. The spring member 64 can readily be pulled rearwardly to release from its engagement with the oppositely-facing interior surface portions 20A, 20B of the enclosure 12. The released spring member 64 then permits insertion or removal of the pictures P to or from the cavity 22.

In addition to the spring member 64, the expandable picture frame assembly 10 employs a pair of locating members 66 attached to the oppositely-facing surface portions 20A, 20B. The locating members 66 are in the form of flat plates 66 having corners holes 68 which receives fastening screws (not shown) for attaching the plates 66 to the surface portions 20A, 20B. The locating plates 66 also have a plurality of pairs of aligned openings 70 for guiding the opposite ends 64A, 64B of the spring member 64 into engagement with aligned locations on the oppositely-facing surface portions 20A, 20B to ensure proper positioning of the spring member 64 for desired flexing between its first and second overcentered positions. The plurality of pairs of aligned openings 70 define different aligned locations for mounting the spring member 64 in order to accommodate different heights of multiple stacked pictures P in the cavity 22. The hooked end 64A of the spring member 64 can be inserted through one of the openings 70 in one locating plate 66, while the opposite downturned end 64B of the spring member 64 can be inserted through a corresponding aligned one of the openings 70 in the other locating plate 66.

Also, preferably, respective recesses 72 are formed at the oppositely facing surface portions 20A, 20B for receiving the opposite ends 64A, 64B of the spring member 64. The locating plates 66 are attached to the oppositely facing surface portions 20A, 20B so as to overlie the recesses 72 and guide the opposite ends 64A, 64B of the spring member 64 through the recesses 72 and into engagement with the opposite surface portions 20A, 20B. The one locating plate 66 through whose opening 70 extends the hooked end 64A of the spring member 64 functions to capture and hold onto the hooked end 64A of the spring member 64 in order to prevent its accidental ejection from the enclosure 12 when it is pulled to its second overcentered position to release it from the enclosure 12.

To insert or remove the transparent pane 42, the backing plate 44 and the stack of pictures P to and from the cavity 22, the spring member 14 is manually pulled and flexed away from the backing plate 44 and then removed from the enclosure 12 by withdrawing its opposite ends 64A, 64B from the openings 70 of the locating plates 66. Then, by pushing against the front side of the transparent pane 42, the pane 42, backing plate 44 and pictures P can be lifted from the cavity 22 through the rear opening 26. Once the desired items have been reinserted in the cavity 22, the opposite ends 64A, 64B of the spring member 64 can be inserted into the desired ones of the locating plate openings 70 and the spring member 64 then flexed to its first overcentered position.

It should be understood that the term "pictures" as used herein is meant to have a broad meaning, including but not limited to photographs, drawings, metals and patches mounted on a stiff board, etc.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. An expandable picture frame assembly, comprising:

(a) an annular enclosure having a front and a rear and an interior annular surface bounding a cavity in said enclosure between said front and rear thereof for storing multiple pictures in a stacked arrangement behind one another, said front of said enclosure having an opening to said cavity for displaying only a front one of the pictures in the stacked arrangement through said front opening, said rear of said enclosure having an opening for inserting and removing the pictures;

(b) a flexible spring member having a free end and being disposed between said front and rear of said annular enclosure and mounted to said interior annular surface of said annular enclosure within said cavity and projecting partially across said cavity, said spring member being capable of flexing toward and away from said front and rear of said enclosure for permitting insertion and removal of the pictures and for holding the pictures in the stacked arrangement within said cavity;

(c) a transparent view pane disposed in said annular enclosure forwardly of said spring member and across the front opening of said enclosure; and (d) a relatively stiff backing plate disposed in said enclosure rearwardly of said transparent view pane and engaged on a rear side solely by said free end of said spring member, said annular enclosure together with said transparent pane, backing plate and flexible spring member enclosing said picture-storing cavity and making it variable in size between said transparent pane and backing plate for confining and holding the multiple pictures in the compact stacked arrangement;

(e) said spring member being capable of flexing away from said backing plate to permit insertion and removal of said transparent pane and backing plate and the pictures into and from said variable-size picture-storing cavity, said spring member having a one-piece structure composed of a flat base portion and an arm portion with said free end, said flat base portion being mounted to said interior annular surface of said enclosure and at least underlying said arm portion and having opposite rear and front longitudinal edges, said arm portion overlying and integrally connected to said rear edge of said base portion and projecting outwardly from said base portion into said picture-storing cavity and forwardly of said front edge of said base portion, said arm portion throughout its length, except for its said free end, extending in an inclined planar configuration and a generally transverse relation to the plane of said flat base portion, said free end of said arm portion being arcuate in shape and being the only portion of said spring member engaging said stiff backing plate, said base portion of said spring member having at least one hole adapting said base portion for attachment to said interior annular surface of said enclosure, said hole being of elongated configuration and oriented to permit movable adjustment of said spring member toward and away from said backing plate to correspondingly increase and decrease the force applied by said free end of said arm portion of said spring member against said backing plate.

2. The picture frame assembly of claim 1 wherein said spring member is composed of a metal material.

3. The picture frame assembly of claim 1 wherein said annular enclosure is a box-like annular frame having a top member, a bottom member and opposite side members spaced apart and extending between said top and bottom members, said top, bottom and side members being rigidly connected together at opposite ends and defining said annular interior surface of said enclosure.

4. The picture frame assembly of claim 3 wherein said bottom member of said frame has a recessed region at said rear of said frame relative to said top member and said side members.

5. The picture frame assembly of claim 4 wherein said opposite side members have longitudinal slots defined therein along said interior surface of said frame, said slots being aligned with one another and with said recessed region of said bottom member to define a track for receiving a rear cover to close said rear opening of said frame.

6. An expandable picture frame assembly, comprising:

(a) a box-like frame having a front and a rear and being composed of a top member, a bottom member, and a pair of opposite side members spaced apart and extending between said top and bottom members, said top, bottom and side members being rigidly connected together at opposite ends and defining an interior annular surface disposed between said front and rear of said frame and bounding and defining a cavity in said frame between said front and rear thereof for storing multiple pictures in a stacked arrangement behind one another, said top, bottom and opposite side members having an interior rim thereon at said front of said frame, forwardly of said interior annular surface, defining an opening to said cavity for displaying only a front one of the pictures in the stacked arrangement through said front opening and defining a shoulder facing toward said rear of said frame, said rear of said frame, at the rear of said interior annular surface, having an opening for inserting and removing the pictures;

(b) a resiliently flexible spring member having a free end and being attached to one of said top, bottom and side members of said frame within said cavity, said spring member projecting partially across said cavity and being capable of flexing toward and away from said front and rear of said frame for permitting insertion and removal of the pictures and for holding the pictures in the stacked arrangement within said cavity;

(c) a transparent view pane disposed in said frame forwardly of said spring member against said shoulder and across said front opening of said frame;

(d) a relatively stiff backing plate disposed in said enclosure rearwardly of said transparent view pane and engaged on a rear side solely by said free end of said spring member, said annular enclosure together with said transparent pane, backing plate and flexible spring member enclosing said picture-storing cavity and making it variable in size between said transparent pane and backing plate for confining and holding the multiple pictures in the compact stacked arrangement;

(e) said spring member being capable of flexing away from said backing plate to permit insertion and removal of said transparent pane and backing plate and the pictures into and from said variable-size picture-storing cavity, said spring member having a flat base portion with opposite rear and front longitudinal edges and being mounted to a portion of said interior annular surface of one of said top, bottom or side members of said frame rearwardly of said interior rim, said spring member also having an arm portion overlying and integrally connected to said rear edge of said base portion and projecting outwardly from said base portion into said picture-storing cavity and forwardly of said front edge of said base portion, said arm portion throughout its length, except for its said free end, extending in an inclined planar configuration and a generally transverse relation to the plane of said flat base portion, said free end of said arm portion being arcuate in shape and being the only portion of said spring member engaging said stiff backing plate, said base portion of said spring member having a pair of holes adapting said base portion for attachment to said interior annular surface of said enclosure, said holes being of elongated configuration and oriented to permit movable adjustment of said spring member toward and away from said backing plate to correspondingly increase and decrease the force applied by said free end of said arm portion of said spring member against said backing plate; and (f) a rear cover capable of closing said rear opening of said frame, said bottom member of said frame having a recessed region at said rear of said frame relative to said opposite side members and said top member, said opposite side members having longitudinal slots defined therein along said interior surface of said frame, said slots being aligned with one another and open at said recessed region of said bottom member to define a linear track for slidably receiving said rear cover through said recessed region of said bottom member and along said linear track for covering and uncovering said rear opening of said frame.

7. The picture frame assembly of claim 6 wherein said spring member is composed of a metal material.

8. A spring member for an expandable picture frame assembly having an enclosure with an interior surface defining a picture-storing cavity, said spring member comprising:

(a) a flat base portion with opposite longitudinal edges and opposite end edges extending between and interconnecting said edges, and means defined through said base portion for mounting said flat base portion to the interior annular surface of the frame assembly enclosure; and (b) an arm portion having a free end and overlying and integrally connected to one of said longitudinal edges of said base portion and projecting in cantilevered fashion outwardly from said base portion, said arm portion throughout its length, except for its said free end, extending in an inclined planar configuration and a generally transverse relation to the plane of said flat base portion, said free end of said arm portion being arcuate in shape and being the only portion of said spring member engaging a stiff backing plate of the picture frame assembly, said arm portion extending into the picture-storing cavity defined by the frame assembly enclosure with said base portion mounted to the enclosure interior surface;

(c) said means defined through said base portion for mounting said flat base portion to the interior annular surface of the frame assembly enclosure being a pair of holes adapting said base portion for attachment to said interior annular surface of said enclosure, said holes being of elongated configuration and oriented to permit movable adjustment of said spring member toward and away from said backing plate to correspondingly increase and decrease the force applied by said free end of said arm portion of said spring member against the backing plate.

9. The spring member of claim 8 wherein said base portion protrudes in opposite directions beyond opposite longitudinal edges of said arm portion, said mounting means being defined in regions of said base portion protruding beyond said arm portion.

* * * * *